US010897943B1

(12) United States Patent
Pagano et al.

(10) Patent No.: US 10,897,943 B1
(45) Date of Patent: Jan. 26, 2021

(54) MULTIPURPOSE, CROSSBODY STRAP WITH UNIVERSAL INTERLOCKING RINGS

(71) Applicants: Scott Pagano, Virginia Beach, VA (US); Kelly J. Hollowell, Virginia Beach, VA (US)

(72) Inventors: Scott Pagano, Virginia Beach, VA (US); Kelly J. Hollowell, Virginia Beach, VA (US)

( * ) Notice: Subject to any disclaimer, the term of this patent is extended or adjusted under 35 U.S.C. 154(b) by 0 days.

(21) Appl. No.: 16/930,089

(22) Filed: Jul. 15, 2020

(51) Int. Cl.

| | |
|---|---|
| ***A44B 11/25*** | (2006.01) |
| ***A45F 3/14*** | (2006.01) |
| ***A45C 13/30*** | (2006.01) |
| ***A41F 9/02*** | (2006.01) |
| ***A44B 11/26*** | (2006.01) |

(52) U.S. Cl.
CPC ..... *A41F 9/025* (2013.01); *A44B 11/263* (2013.01); *A44B 11/2592* (2013.01); *A45C 13/30* (2013.01); *A45F 3/14* (2013.01); *A45F 2003/142* (2013.01)

(58) Field of Classification Search
CPC ..... A44B 11/25; A44B 11/26; A44B 11/263; A44B 11/28; A44B 11/2592; A45C 13/30; A45F 3/14; A45F 2003/142
USPC ..... 224/257, 258, 578
See application file for complete search history.

(56) References Cited

U.S. PATENT DOCUMENTS

| | | | | | |
|---|---|---|---|---|---|
| 769,037 | A * | 8/1904 | Wechsler | A44B 11/28 | 24/312 |
| 1,772,393 | A * | 8/1930 | Guttman | A44B 11/28 | 24/601.8 |
| 2,025,886 | A * | 12/1935 | Nordstrom | A41F 9/002 | 224/587 |
| 2,262,269 | A * | 11/1941 | Cooper | A44B 11/25 | 24/163 R |
| 2,480,874 | A * | 9/1949 | Neumann | A44B 11/25 | 24/168 |
| 2,809,408 | A * | 10/1957 | Goldstein | A44B 11/25 | 24/312 |
| 3,931,917 | A * | 1/1976 | Zellmer | A45F 5/00 | 224/602 |
| D278,386 | S * | 4/1985 | Share | 224/902 | |
| D279,424 | S * | 7/1985 | Leiserson | 224/902 | |
| 4,525,879 | A * | 7/1985 | Kalomeris | A45C 1/04 | 2/247 |

(Continued)

FOREIGN PATENT DOCUMENTS

| | | |
|---|---|---|
| CA | 2 790 127 A1 | 11/2012 |
| CN | 202504515 U | 10/2012 |

(Continued)

*Primary Examiner* — Justin M Larson
(74) *Attorney, Agent, or Firm* — 21st Century IP LLC; Kelly Hollowell

(57) ABSTRACT

An ambidextrous, adjustable cross-body strap comprising a plurality of variably sized pockets, a buckle and universal interlocking keyring system for added user security. The cross-body strap can be worn under or over a shirt or jacket. In one embodiment, it is water resistant or waterproof. In one embodiment, the cross-body strap has interchangeable clasps and hooks that are stored in one of the plurality of pockets built into the strap. The interchangeable clasps hook and carabiners can be used separately or in combination with the universal interlocking rings to self-attach or alternatively attach to any messenger bag, gym bag tactical clips, such as a keyring holder, straps with snaps or briefcase.

13 Claims, 8 Drawing Sheets

(56) References Cited

U.S. PATENT DOCUMENTS

| | | | | |
|---|---|---|---|---|
| 4,747,527 | A | 5/1988 | Trumpower, II | |
| 4,923,105 | A | 5/1990 | Snyder | |
| 5,950,893 | A * | 9/1999 | Heggeland | A45C 13/26 150/107 |
| 6,662,986 | B2 | 12/2003 | Lehtonen | |
| 6,834,621 | B1 | 12/2004 | O'Neill | |
| D505,787 | S * | 6/2005 | Vaughn | D3/224 |
| 7,059,371 | B2 | 6/2006 | Renn | |
| 7,278,684 | B2 | 10/2007 | Boyle | |
| 7,699,197 | B2 | 4/2010 | Panosian et al. | |
| 8,225,973 | B1 * | 7/2012 | Bellinson | A45F 3/02 224/602 |
| 9,044,080 | B2 | 6/2015 | Ashenafi | |
| 9,526,301 | B1 * | 12/2016 | Sloan | A44B 11/006 |
| 9,560,898 | B2 * | 2/2017 | Hortnagl | A44B 11/2592 |
| 9,854,889 | B2 | 1/2018 | Amago | |
| 10,340,636 | B1 * | 7/2019 | Twenge | A44B 11/28 |
| 2007/0084895 | A1 * | 4/2007 | Bowen | A45C 1/04 224/660 |
| 2009/0194571 | A1 | 8/2009 | Evans | |
| 2010/0025447 | A1 * | 2/2010 | Smart | F42B 39/02 224/682 |
| 2015/0313337 | A1 | 11/2015 | Swartzel | |
| 2016/0037876 | A1 | 2/2016 | Perkins et al. | |
| 2016/0206061 | A1 | 7/2016 | Ford | |
| 2016/0286941 | A1 * | 10/2016 | Wheeler-Christ | A45F 3/02 |
| 2019/0014888 | A1 * | 1/2019 | Duncan | A45F 3/14 |
| 2019/0191853 | A1 * | 6/2019 | Carter | A45F 3/14 |
| 2020/0000198 | A1 * | 1/2020 | Schroeder | A45C 13/30 |

FOREIGN PATENT DOCUMENTS

| | | | |
|---|---|---|---|
| CN | 205358486 | U | 7/2016 |
| DE | 20 2015 103 111 | U1 | 7/2015 |
| WO | 2013/014425 | A1 | 1/2013 |

* cited by examiner

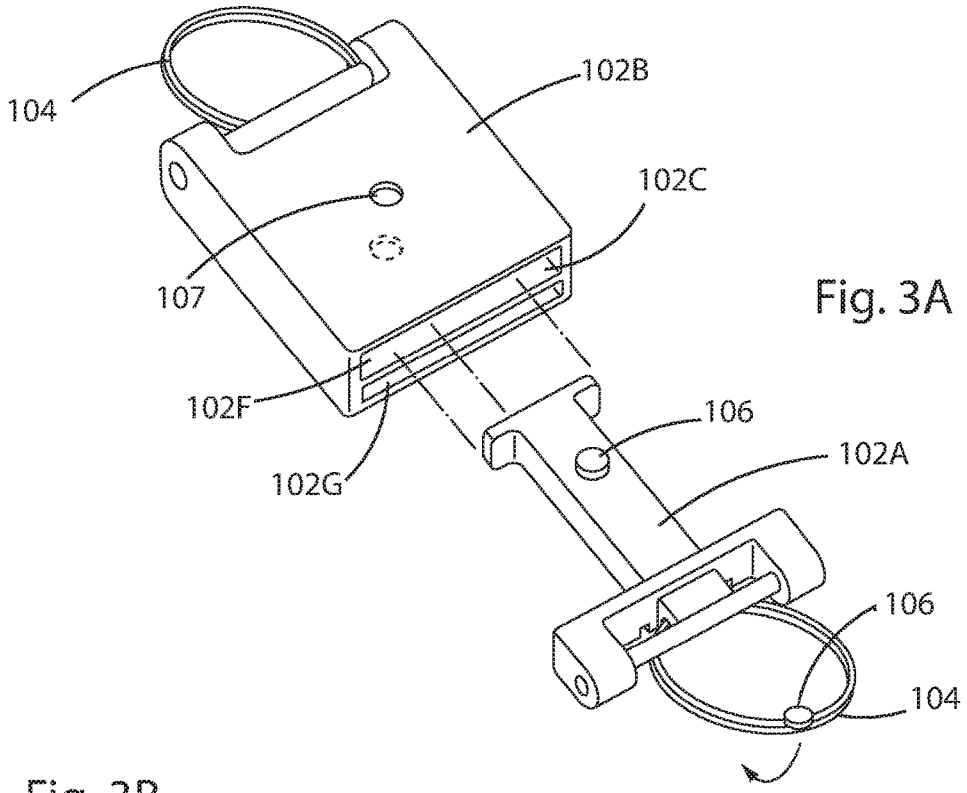
Fig. 3A
Fig. 3B
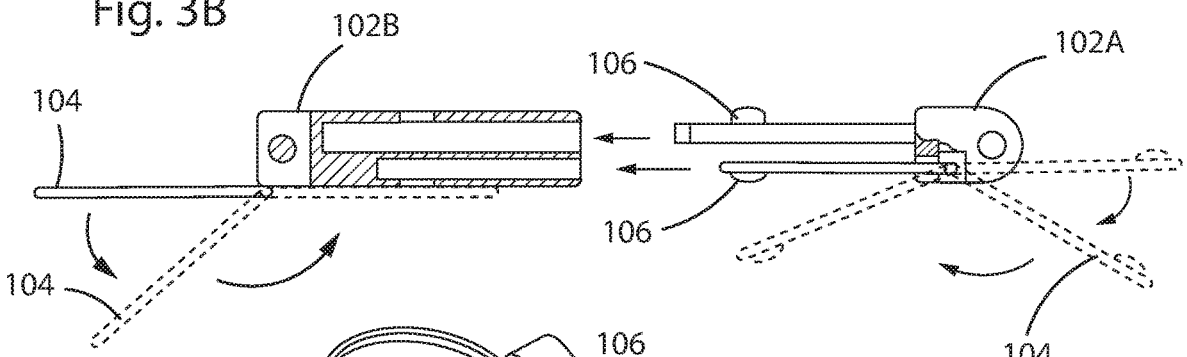
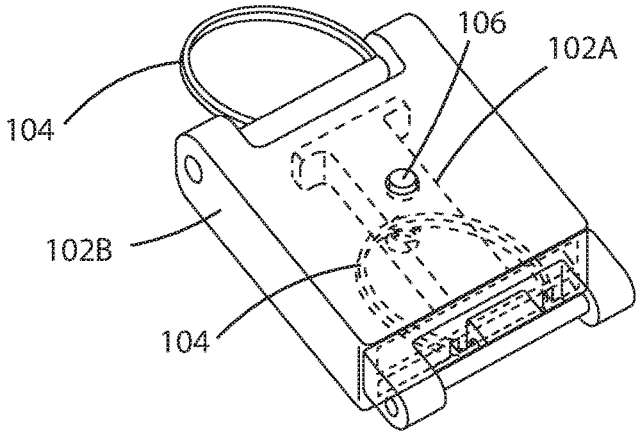
Fig. 3C

MULTIPURPOSE, CROSSBODY STRAP WITH UNIVERSAL INTERLOCKING RINGS

FIELD OF THE INVENTION

The present invention combines a men's wallet with the capacity of a fanny pack, the fashion of a chest sling and the multifunctional utility of a duty belt. It is a fashionable ambidextrous adjustable cross-body strap with a buckle, buckle slide cover, a universal keyring lock system and a plurality of variably sized pockets located on both sides of the strap. It is perfect for outdoorsman but also fashionable and discreet for wearing under business attire. It is made of sturdy but sleek water resistant or waterproof material and the plurality of variably sized pockets are suitable for money, credit cards, pocketknife, cell phone, keys, notes, ear pods, blue tooth technology, phone charger etc. The buckle adapted ends of the cross-body strap co-terminate with a universal keyring system that can be linked together for added security alternatively, the universal keyring system can be linked to a traditional shoulder bag or suitcase when larger storage is required. The slidable buckle cover also provides a third layer of security as protection against accidental release of the buckle and strap.

BACKGROUND OF THE INVENTION

A wallet is a small, flat case used to carry small personal items such as money, credit cards, and identification. Wallets are often pocket-sized, discreet and generally made of leather or fabric. Wallets may also have features such as money clips; a coin purse; a chain fastener, strap or a zipper. In addition to their practical function, wallets may be used as a fashion accessory.

There are many types of wallets. For example, a Breast wallet is used for folded money and credit cards and carried in the breast pocket of a man's jacket. A Money clip wallet is similar to a front pocket wallet in terms of size. However, the money is usually held in by a clip secured by a strong magnet. A Long wallet is a larger wallet that includes a coin purse and is usually worn with jeans, fastened by a chain or leather strap. An ID case/neck pouch is often a thin nylon or leather case with plastic see-through compartments designed to hold an ID card, credit card and/or a few bills. A Shoe wallet is a small pouch attached to a shoe designed primarily for people exercising. A Tactical wallet is a wallet and Swiss army knife rolled into one, complete with a small knife, bottle opener, or other gadgetry. Money belts, a larger version of the traditional wallet, are belts with secret compartments often worn by tourists to protect valuables from thieves and/or pickpockets, while the man purse is a cross-body that gave rise to the fanny pack which is a small fabric pouch worn around the waist.

Although the fanny pack is as emasculating as the man purse; their practicality makes them very popular. Mobile devices (and USB charging cables and backup batteries), keys, money, credit cards, IDs, bottles of water, snacks, tissue paper, first aid, isopropyl alcohol, and glasses are among some of the most common items stored in the bag. More recently the fanny pack has been replaced by the slightly edgier chest sling. Sling bags are a fashion statement, but also a convenient way to carry the essentials while traveling about in an uber tech world. Think of them as the middle ground between a backpack and your pockets.

On the other end of fashion and extremely masculine are the duty belts (sometimes referred to as a gun belt, "duty rig" and/or kit belt). These are belts, typically worn by law enforcement, military and handymen to carry equipment easily in a series of pouches attached to the belt, in a readily accessible manner, while leaving the hands free to interact. This belt can carry any number of useful items, ranging from keys, money, batteries, gloves, pens, pencils, keys, multi-tool, window punch handcuffs to guns. Duty belts wrap commonly around the user's waist and often fasten with a buckle at the front. Belt suspenders are often used with a duty belt to move a portion of the weight of the belt onto the shoulders, reducing the weight imposed on the lower back.

None of these traditional devices provides a practical and fashionable solution for the modern man in and ever-increasing techno-gadget world. What is needed is the discretion of a traditional man's wallet combined with the capacity of a fanny pack, fashion of sling bag and masculinity of an adjustable utility belt that can be securely worn either under or over men's clothes and provide maximum functionality and fashion.

SUMMARY OF THE INVENTION

The present invention combines the features of a men's wallet with the capacity of a fanny pack with a multifunctional utility or duty belt in a fashionable ambidextrous adjustable cross-body pocketed strap. It can be worn discreetly under a shirt or jacket but is also fashionable outerwear; with or without a shirt. It is perfect for outdoorsman but also a gentlemen's replacement for a traditional wallet, fanny pack or chest sling. It has a sleek design with a plurality of variably sized pockets for cell phone, keys, notes, ear pods, blue tooth technology, phone charger etc. The ends of the cross-body strap attach to each other with a unique buckle and universal interlocking ring. In addition, the universal interlocking ring system can self-attach or can clip onto a traditional shoulder bag, backpack or carryon luggage. Replacing a traditional three-way buckle system, the current invention includes a quick release buckle, a slidable buckle cover and a universal interlocking keyring system to decrease accidental release of the strap by anyone but its wearer.

BRIEF DESCRIPTION OF DRAWINGS

FIG. 3A-3C is a perspective view of the cross-body strap open and closed buckle.

DETAILED DESCRIPTION OF THE PREFERRED EMBODIMENTS

It is to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
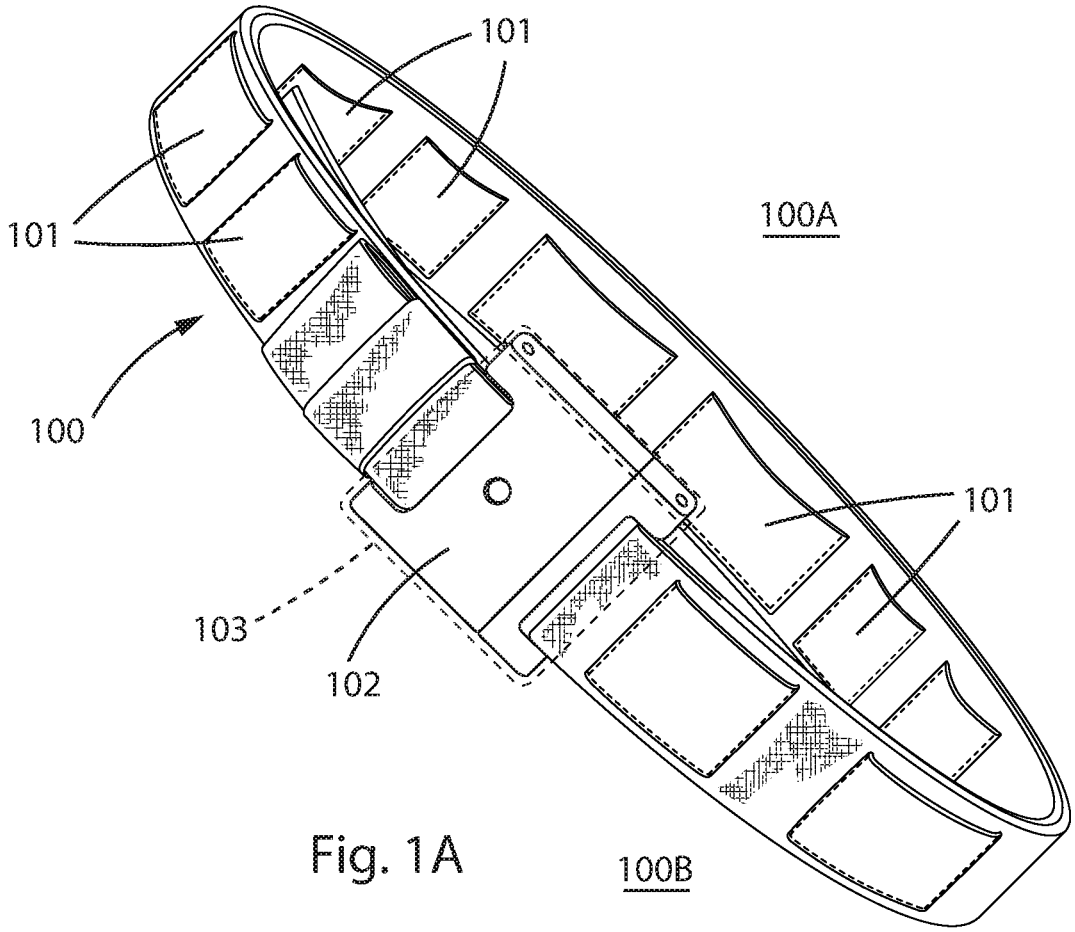
FIG. 1A is a perspective view of the cross-body strap with buckle slide cover.
Figure 1B:
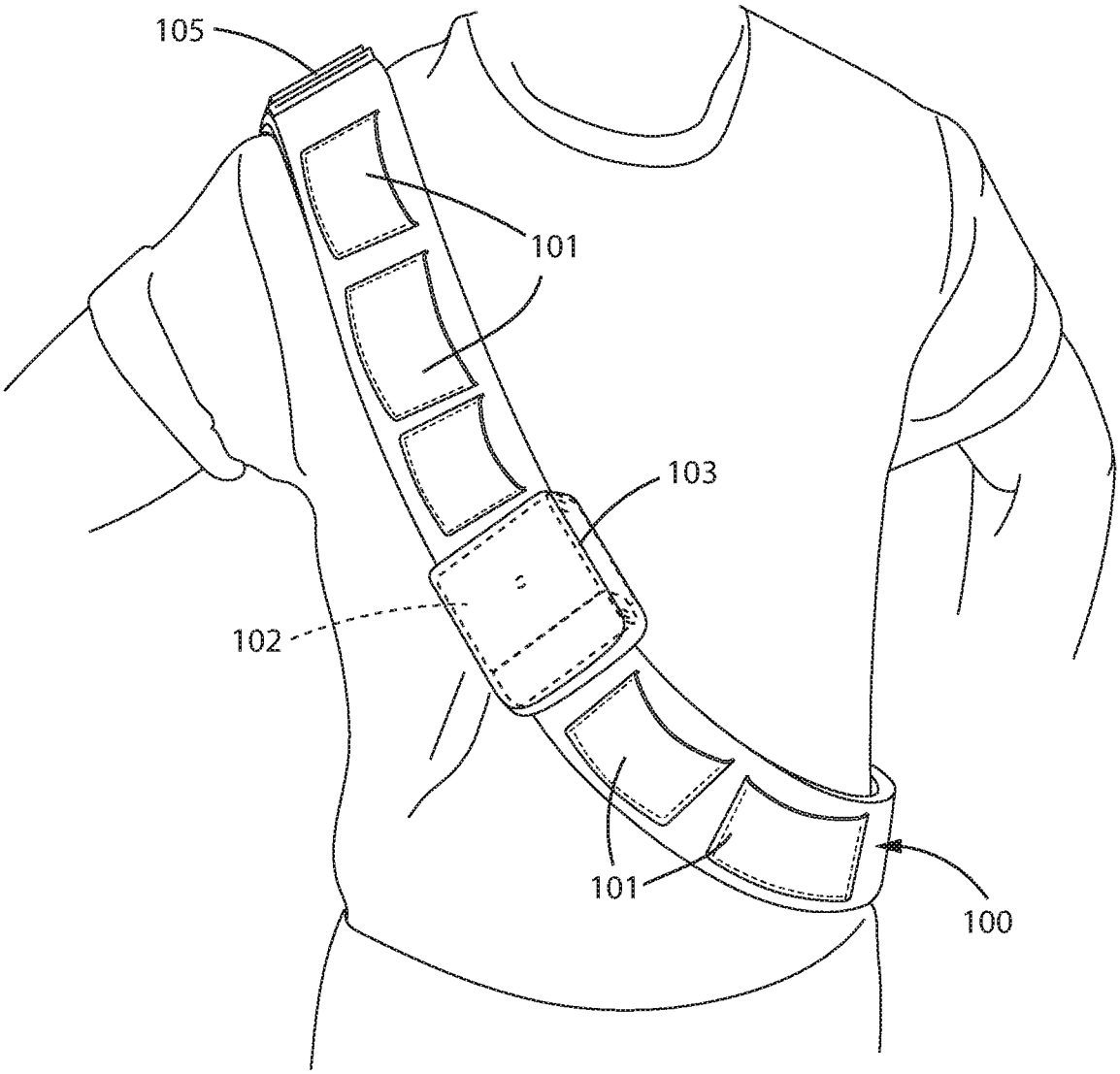
FIG. 1B is a perspective view of the cross-body strap as worn by a user.

FIG. 1A provides a perspective view respectively of the cross-body strap 100 having an adjustable length terminating in a closed buckle 102, a slidable buckle cover 103 covering the buckle 102, and a strap length adjuster 105 such as a tri-glide slide making the cross-body strap 100 able to be adjusted to fit the user. FIG. 1B provides a view of the cross-body strap with buckle slide cover as worn by a user.

Figure 2:
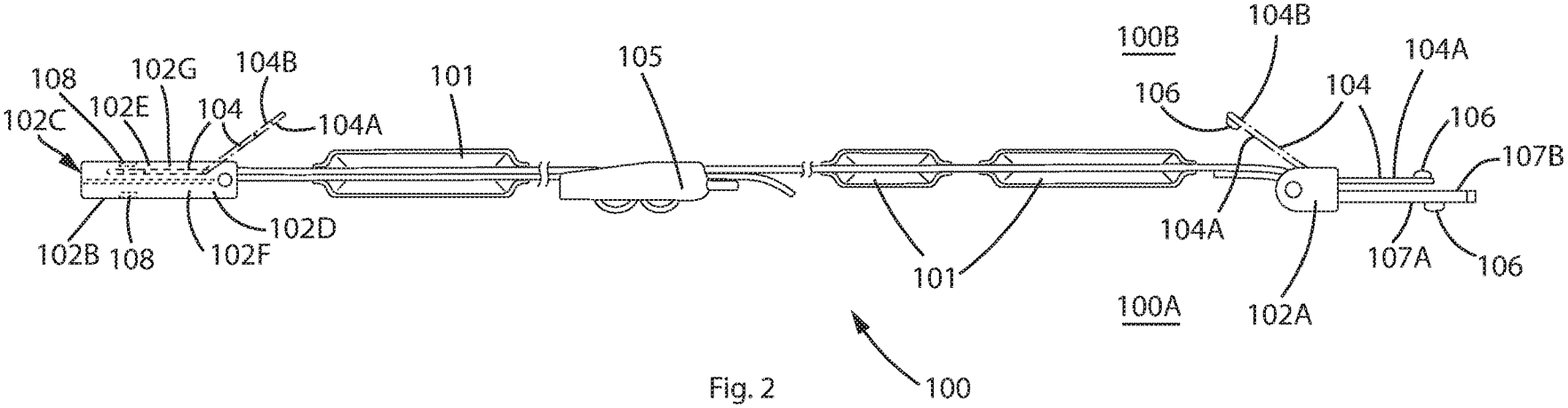
FIG. 2 is a side perspective view of the cross-body strap.

FIG. 2 provides a side perspective view of the cross-body strap 100 in the open position. In this illustration, the buckle 102 is shown detached in two interlocking parts: a male end 102A and a female end 102B. The male end 102A comprises a first movable ring 104 with a bottom surface 104A and a top surface 104B that is mechanically connected to a prong 107 comprising a bottom surface 107A and a top surface 107B; and a first compressible button 106 located on the prong bottom surface 107A and a second compressible button 106 located on the ring bottom surface 104A.

Also shown in FIG. 2, the female end 102B comprises a second movable ring 104 with a bottom surface 104A and a top surface 104B that is mechanically connected to a horizontally bifurcated slot 102C comprising a top outer surface 102D, a bottom outer surface 102E, a top cavity 102F and a bottom cavity 102G; and a first locking button hole 108 located on the top outer surface 102D and a second locking button hole 108 located on the bottom outer surface 102E. FIG. 2 also illustrates a strap adjuster 105, commonly known in the art, to adjust the length of the strap 100 to the user's preference and body size.

FIGS. 3A-3C show a closed embodiment of the cross-body strap 100 in which prong 107 is inserted into the top cavity 102F of the bifurcated slot 102C and the first compressible button 106 located on the prong bottom surface 107A is inserted into the first locking button hole 108 located on the top outer surface 102D of the bifurcated slot 102C; and the first movable ring 104 operably connected to the prong 107 is inserted into the bottom cavity 102G of the bifurcated slot 102C and the second compressible button 106 into the second locking button hole 108 located on the bottom outer surface 102E of the bifurcated slot 102C. In this configuration, the inserted prong 107 and the inserted first movable ring 104 provide a dual locking system for buckle 102 and overall strap 100. The compressible button 106 provide a quick release mechanism. The buckle 102 is unlocked or released by pressing the first and second compressible buttons 106.

Traditionally, money and/or utility belts have been fastened using a metal buckle; however, this is changing for a number of reasons. Now plastic buckles are more common, and many incorporate a three-way buckle system for added security. As an example, some systems require the wearer to depress a third release catch before the buckles may be separated; this is to decrease the chance of the belt being released by anyone but its wearer. This traditional three-way buckle system is replaced by the present invention with a unique three-way locking buckle and a universal interlocking ring system that can self-attach or attach to a larger luggage unit.

In one embodiment, the slidable buckle cover 103 is made of incompressible material such as but not limited to a hard plastic or thin metal. The slidable buckle cover 103 therefore serves as an external safety mechanism that prevents accidental access or release of the first and second compressible buttons 106. In one embodiment, the buckle slide cover may be embossed with initials or insignia for an individual, military unit or team. In another embodiment, it may be embossed or imprinted with a logo or other symbol to connote a particular brand or convey a message.

Figure 4B:
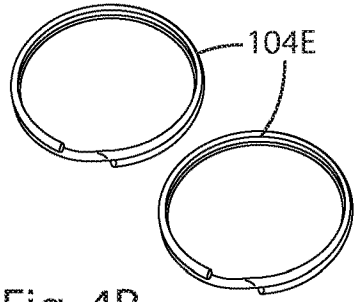
FIG. 4A-4C is a perspective view of the cross-body strap interlocking rings.
Figure 4A:
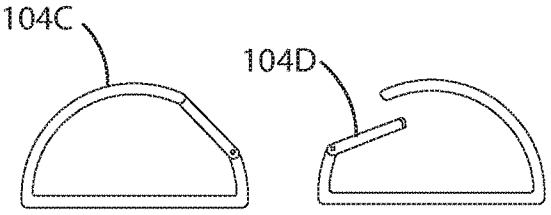
Figure 4C:
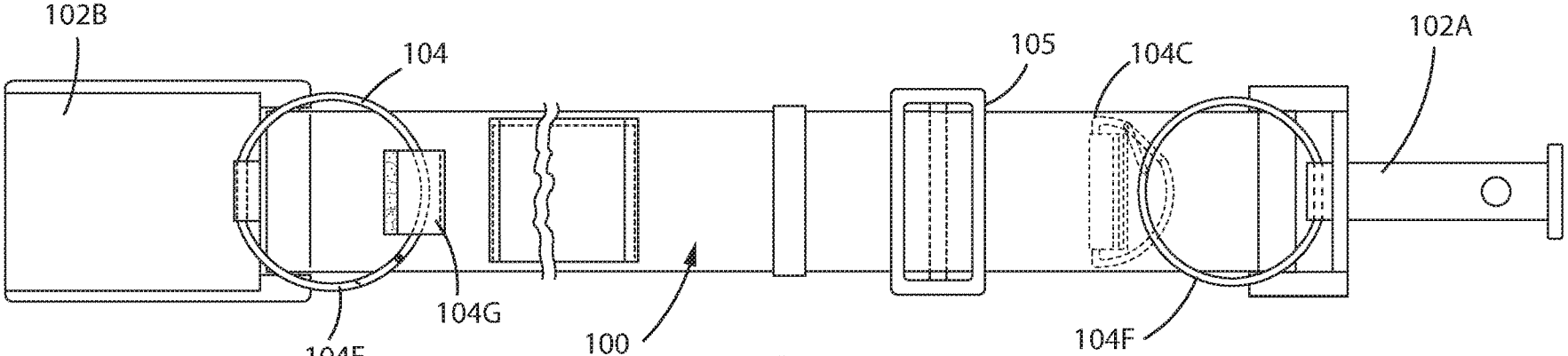

FIGS. 4A and 4B illustrate exemplary embodiments for the first and second movable rings. FIG. 4A illustrates a D-ring 104C with a collapsible latch 104D. FIG. 4B illustrates a keyring configuration referred to hereafter as "keyrings". FIG. 4C illustrated a circular ring 104F with a collapsible latch 104D as shown with the D-ring 104C. When the movable rings are not in use, they may be held in place by a Velcro strap 104G located on the bottom or back surface 100B of the strap.

In another embodiment and as commonly known the art, the Velcro strap 104G can be substituted with any similar mechanism such as but not limited to a strap with a snap or button (not shown). The rings might also be held in place by a sleeve or pocket located on the bottom or back surface 100B of the strap 100 (not shown). In one embodiment, the D-ring 104C can be sewn into the bottom or back surface 100B of the strap 100 and the collapsible latch 104D can be opened to interconnect the rings and hold the movable keyrings to the back surface 100B of the strap 100. Securing the movable rings to the bottom or back surface 100B of the strap 100 hides them from view when not in use to create a clean look on the top or front surface 100A of the strap 100.

Figure 5A:
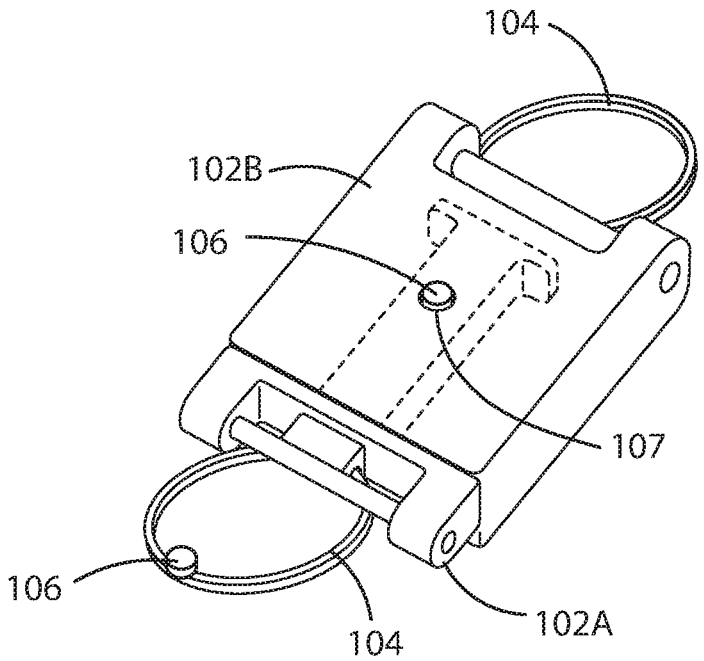
FIG. 5A-5B is perspective view of an alternate locking embodiment.
Figure 5B:
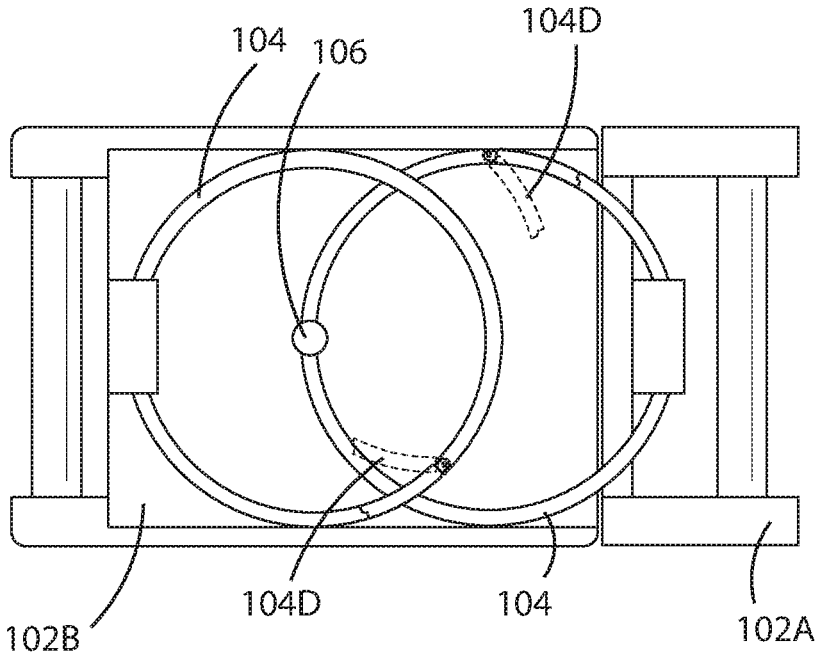

FIG. 5A shows a closed embodiment of the cross-body strap 100 in which prong 107 is inserted into the top cavity 102F of the bifurcated slot 102C and the first compressible button 106 located on the prong bottom surface 107A is inserted into the first locking button hole 108 located on the top outer surface 102D of the bifurcated slot 102C. FIG. 5B shows a closed embodiment of the cross-body strap 100 in which the first movable ring 104 mechanically connected to the prong 107 is interlinked with the second movable ring 104 mechanically connected to the horizontally bifurcated slot 102C. In this configuration, the inserted prong 107 and the interlinked first and second ring 104 provide an added measure of security in locking the strap 100 to the user's body. The buckle 102 is unlocked or released by pressing the first compressible button 106 and disconnecting the movable rings 104.

Figure 6:
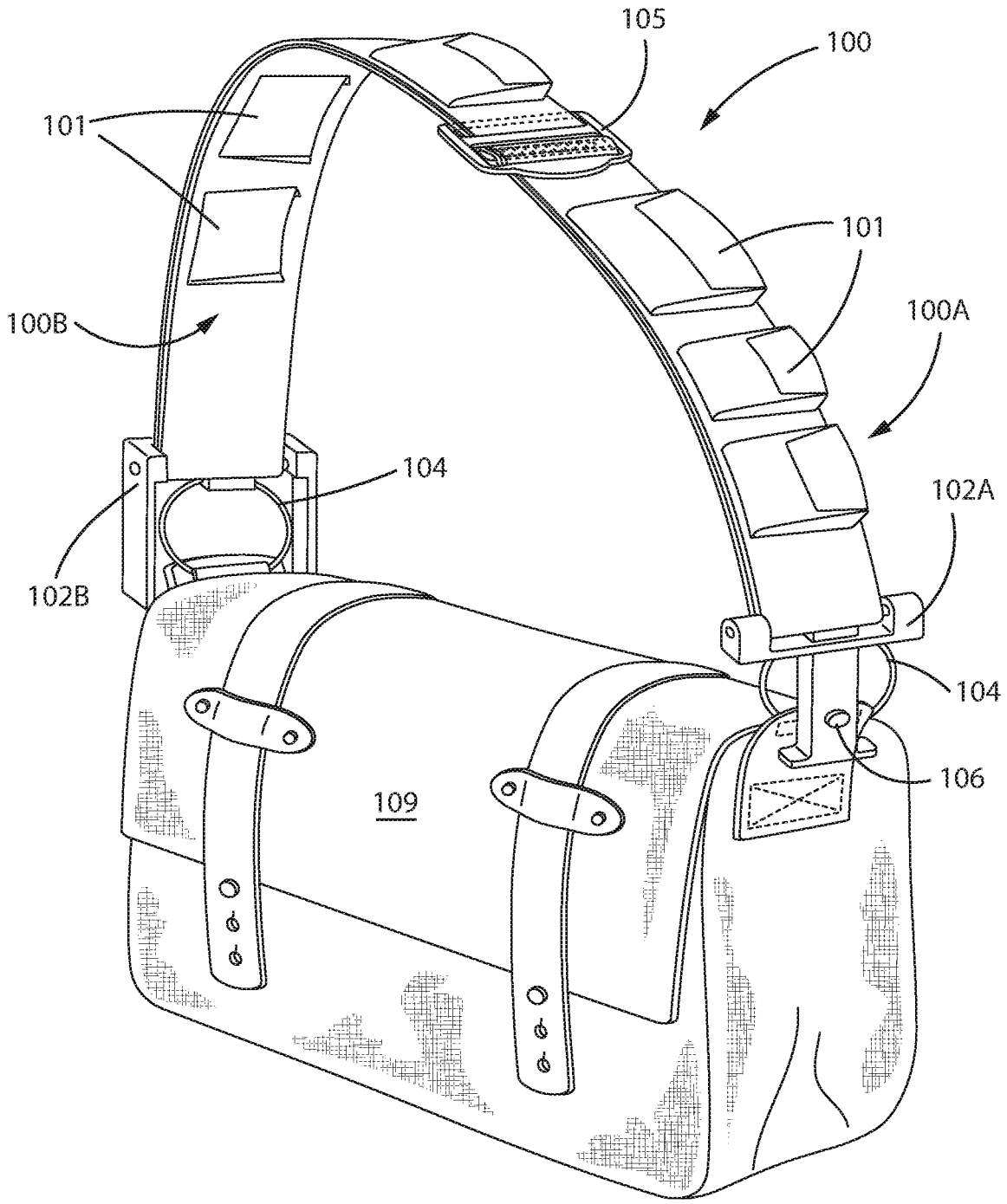
FIG. 6 is a perspective view of the cross-body strap attached to suitcase.

In one embodiment, the first movable ring 104 and second movable ring 104 operate as a universal interlocking ring system as illustrated in FIG. 6. More specifically, rings 104 can attach to each other or be linked to a traditional shoulder bag, fanny pack or suitcase when larger storage capacity is required. Depending on the configuration of the larger bag or suitcase, the strap 100 might also be engaged as describe in FIGS. 3-5 under a larger suitcase flap 109 such as the one shown FIG. 6. In this embodiment, a user may carry a bag onto an airplane, for example, and quickly release the larger bag for storage into an overhead compartment and then just as quickly buckle the strap 100 back to the user. This keeps all necessary personal items such as tickets, money, phone or medicine at the user's fingertips; no more rummaging through a suitcase for the items the user wants close at hand.

Figure 7A:
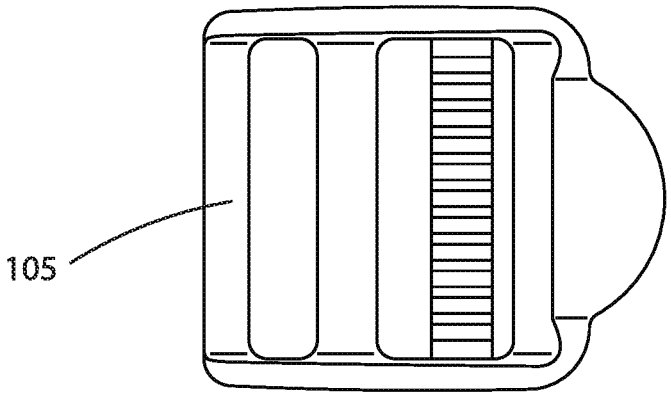
FIG. 7A-7B is an enlarged perspective view of the top and bottom of the strap adjuster.
Figure 7B:
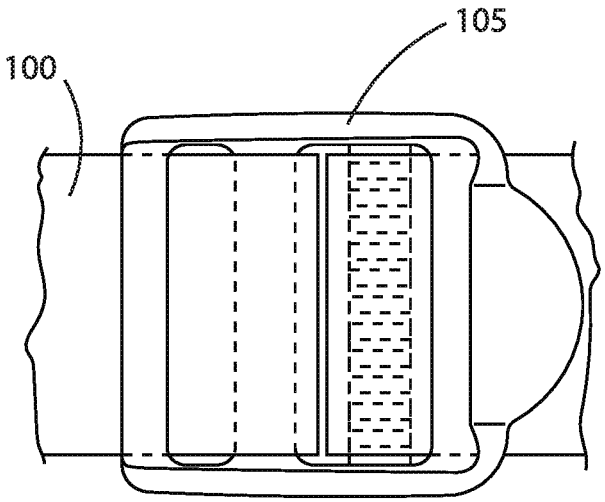

FIGS. 7A and 7B illustrate a top and bottom view respectively of a commonly known and used tri-bar strap adjuster 105. Historically belts, straps slings and backpacks have and use tri-glide slides, making them able to be adjusted to fit. In one embodiment, the dimensions of the strap may range from 48 to 86 inches in length and from 1.5 to 5 inches in width. In one embodiment, the width is 2.25 inches. In one embodiment, the length is 66 inches and the width is 2.5 inches.

As illustrated and discussed above, the present invention combines a men's wallet with the capacity of a fanny pack, the fashion of a chest sling and the multifunctional utility of a duty belt. It is a fashionable ambidextrous adjustable cross-body pocketed strap with a buckle, buckle slide cover, a universal keyring lock system and a plurality of variably sized pockets located on both sides of the strap worn over or under clothes. It is perfect for outdoorsman but also fashionable and discreet for wearing under business attire. It is made of sturdy but sleek water resistant or waterproof material and the plurality of variably sized pockets are suitable for money, credit cards, pocketknife, cell phone, reflectors, keys, notes, ear pods, blue tooth technology, phone charger etc. In one embodiment, at least one of the plurality of variably sized pockets is expandable to hold larger item's like a water bottle or small firearm.

In one embodiment, some of the pockets may also contain various mechanical fasteners such as hooks, carabiners and small straps that may be used to connect to a dog leash, gloves, various sport gear and/or any item you want attached by rope or cord. The buckle adapted ends of the cross-body strap co-terminate with a universal keyring system that can be linked together, to the buckle or alternatively linked to a traditional shoulder bag, fanny pack or suitcase when larger storage is required. The buckle slide cover and universal lock system also provide added security as external safety mechanisms to prevent accidental release of the strap should the buckle disengage. In one aspect of the present invention, the cross-body strap for a larger bag, but it's all about the strap and not the bag for everyday use. The strap can just be released from the bag and taken anywhere. It has a plurality of variably sized inserts and pockets for cell phone, keys, notes, ear pods, blue tooth technology, phone charger etc. In one embodiment, the cross-body strap has Bluetooth technology.

The traditional material for wallets is leather or fabric, but many other flexible flat sheet materials can be used in their fabrication. Non-woven textiles such as Tyvek are used, sometimes including reuse of waterproof maps printed on that material. Woven metals, such as fine mesh made of copper or stainless steel have been incorporated into wallets that are promoted as having electromagnetic shielding properties to protect against unauthorized scanning of embedded NFC & RFID tags. Any of these same materials or combination of materials can be sued for the cross-body strap. Other fabrics used to make the cross-body strap include but are not limited to nylon, polyester, laminate, ripstop, cotton, felt, rubber, plastic, PVC, etc.

In one embodiment, the cross-body strap and its pockets are made of water-resistant material. In another embodiment the cross-body strap and its pockets is completely waterproof. Pockets can be made not only of water resistant or waterproof material but can also be sealed with zip locks and waterproof casings such as but not limited to those used for phones and cameras which are commonly known in the art. In another embodiment, the cross-body strap is made in whole or in part of reflective material. The clasps and buckles can be substituted with button, snaps and Velcro. The buckle can be substituted with other well-known clasps, fasteners, hooks, carabiners, brooch, buckle, catch, clamp, clench, clinch, clip, clutch, embrace, fastening, fibula, grapple, grasp or grip, and Velcro.

An alternate use for the cross-body strap includes but is not limited to use as a reflector at night for bikers and joggers. In one embodiment, the cross-body strap comprises a panic alarm button. In one embodiment, the cross-body strap comprises a flotation device. In one embodiment, the cross-body strap comprises a beacon and/or a tracking system for people with special needs or elderly experiencing memory loss. In another embodiment, the cross-body strap can be designed for men, women, children and the elderly wherein the pocket design can be selected for particular needs with personalized features.

These and other advantages of the invention will be further understood and appreciated by those skilled in the art by reference to the following written specification, claims and appended drawings. In the foregoing description, it will be readily appreciated by those skilled in the art that modifications may be made to the invention without departing from the concepts disclosed herein. Such modifications are to be considered as included in the following claims, unless the claims by their language expressly state otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

While various embodiments of the present disclosure have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to implement the desired features of the present disclosure. Additionally, with regard to operational descriptions and method claims, the order in which the steps are presented herein shall not mandate that various embodiments be implemented to perform the recited functionality in the same order unless the context dictates otherwise.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present invention should not be limited by any of the above-described exemplary embodiments.

What is claimed is:

1. A cross-body adjustable strap comprising:

a length adjustable strap terminating in a buckle comprising a male end and female end, said strap comprising a front surface and a back surface;

a plurality of variably sized pockets attached to the strap front surface and back surface;

a strap length adjuster movably attached to the strap; and a universal interlocking ring system comprising a first movable ring attached to the male end of the buckle and a second movable ring attached to the female end of the buckle; wherein the female end of the buckle comprises at least one cavity to receive the first movable ring.

2. The male end of the buckle of claim 1, further comprising a prong comprising a bottom surface and a top surface; and a first compressible button located on the prong bottom surface; the first movable ring comprises a bottom surface and a top surface and a second compressible button located on the ring bottom surface; the female end of the buckle comprises a horizontally bifurcated slot comprising a top outer surface, a bottom outer surface, a top cavity configured to receive the prong and a bottom cavity configured to receive the first movable ring, a first locking button hole located on the top outer surface; and a second locking button hole located on the bottom outer surface.

3. The cross-body adjustable strap of claim 1, further comprising a slidable buckle cover movably attached to the strap, wherein slidable buckle cover is made of incompressible material.

4. The cross-body adjustable strap of claim 1, wherein the strap is water resistant.

5. The cross-body adjustable strap of claim 1, wherein the strap is waterproof.

6. The cross-body adjustable strap of claim 1, wherein the first and second movable rings are D-Rings with a collapsible latch.

7. The cross-body adjustable strap of claim 1, wherein the first and second movable rings are circular rings with a collapsible latch.

8. The cross-body adjustable strap of claim 1, wherein the first and second movable rings are keyrings.

9. The cross-body adjustable strap of claim 1, further comprising a hook and loop strap located on the bottom or back surface of the strap.

10. The cross-body adjustable strap of claim 1, further comprising a D-ring with a collapsible latch sewn into the bottom or back surface of the strap.

11. The cross-body adjustable strap of claim 1, wherein at least one of the plurality of variably sized pocket is expandable.

12. The cross-body adjustable strap of claim 1, wherein the dimensions of the strap are from 48 to 86 inches in length and 1.5 to 5 inches in width.

13. The cross-body adjustable strap of claim 1, wherein the dimensions of the strap are 66 inches in length and 2.5 inches in width.

* * * * *